United States Patent [19]

Garwood

[11] Patent Number: 4,685,274

[45] Date of Patent: Aug. 11, 1987

[54] PACKAGING FOODSTUFFS

[75] Inventor: Anthony J. M. Garwood, Victoria, Australia

[73] Assignee: Garwood Ltd., Victoria, Australia

[21] Appl. No.: 717,235

[22] PCT Filed: Jul. 12, 1984

[86] PCT No.: PCT/AU84/00131

§ 371 Date: Mar. 12, 1985

§ 102(e) Date: Mar. 12, 1985

[87] PCT Pub. No.: WO85/00339

PCT Pub. Date: Jan. 31, 1985

[30] Foreign Application Priority Data

Jul. 12, 1983 [AU] Australia ..... PG0246

[51] Int. Cl.[4] ..... B65B 31/04; B65B 31/06; B65B 47/10

[52] U.S. Cl. ..... 53/433; 53/453; 53/511; 53/559

[58] Field of Search ..... 53/433, 511, 449, 173, 53/453, 559; 229/2.5 R; 206/524.8, 213.1; 220/72; 426/129, 118

[56] References Cited

U.S. PATENT DOCUMENTS

| | | | |
|---|---|---|---|
| 3,155,303 | 11/1964 | Fenkel | 426/129 X |
| 3,253,762 | 5/1966 | Gaunt | 426/129 X |
| 3,351,265 | 11/1967 | Miller | 426/129 X |
| 3,438,507 | 4/1969 | Kreuger | 426/129 X |
| 3,480,197 | 11/1969 | Massey | 426/129 X |
| 3,583,623 | 6/1971 | Golner et al. | 220/72 X |
| 3,740,238 | 6/1973 | Graham | 220/72 X |
| 3,745,742 | 7/1973 | Tartarini | 53/511 |
| 4,058,953 | 11/1977 | Sanborn, Jr. et al. | 53/433 |
| 4,162,599 | 7/1979 | Kyle | 53/511 X |
| 4,409,252 | 10/1983 | Buschkens et al. | 53/433 X |
| 4,548,852 | 10/1985 | Mitchell | 53/432 X |

*Primary Examiner*—Horace M. Culver

*Attorney, Agent, or Firm*—Cushman, Darby & Cushman

[57] ABSTRACT

Packaging for foodstuffs, particularly meat, comprises a rigid tray (3) of plastic material, preferably polypropylene, enclosed between two opposing, preferably transparent, plastic webs (2, 4), one of which (4) has a depression formed therein in which the tray nests. The tray has corrugations (5) which give it its rigidity, with those on the base (7) also serving to support and space the contents above the base. The package is air evacuated and filled with a desired gas to prevent deterioration of the contents. The method of packaging essentially entails placing the tray, with contents, in the depression, overlying the upper web, evacuating and gasifying the partially completed package and sealing the webs together. Apparatus for performing the method is also disclosed.

17 Claims, 8 Drawing Figures

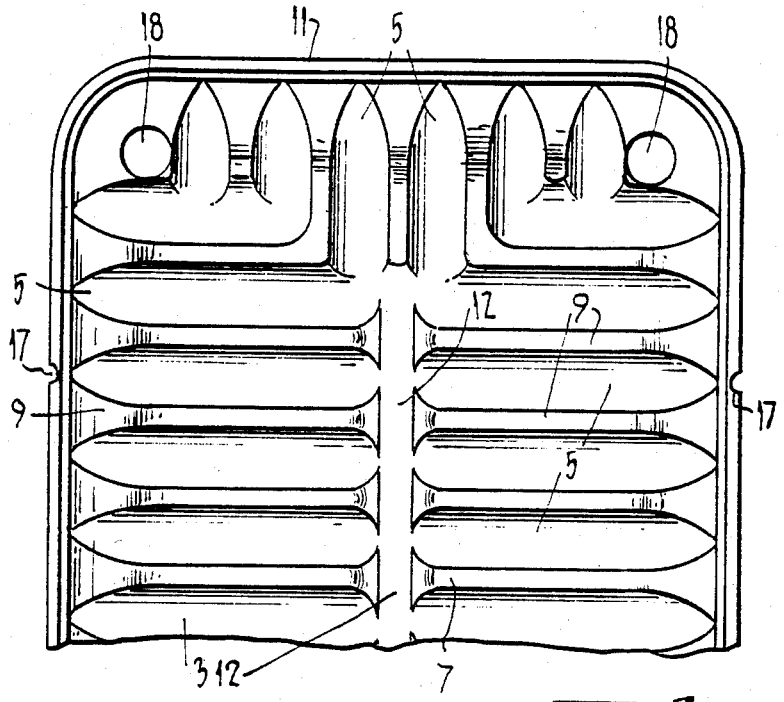
FIG. 2.
FIG. 3.
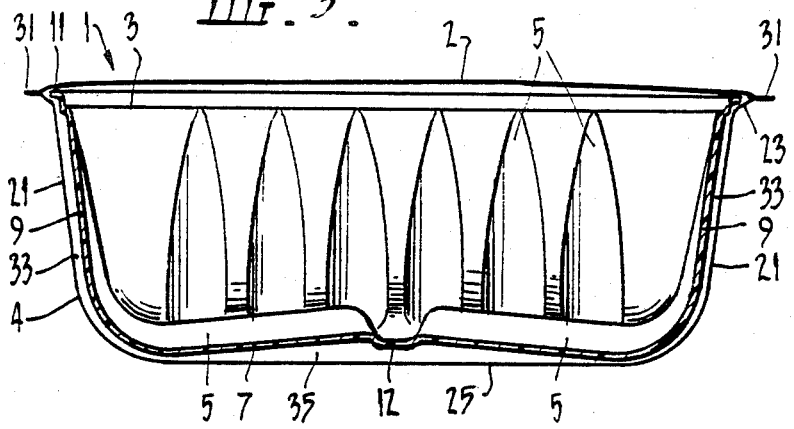

PACKAGING FOODSTUFFS

BACKGROUND OF THE INVENTION

This invention relates to improved packaging and relates particularly but not exclusively to improved packaging suitable for the packaging of meats and other foodstuffs which can deteriorate in air.

DESCRIPTION OF PRIOR ART

Hitherto, fresh meat has been packed in packages which comprise an expanded POLYSTYRENE foam tray or like plastics foam tray, and a covering of clear plastics material wrapping such as of P.V.C. or POLYETHYLENE. A problem with such prior art packages is that a purchaser can not inspect the underneath of the meat because the tray is not transparent.

It is desirable but not essential to package fresh meat in packaging where at least two sides of the meat can be viewed by an intending purchaser. When meat is packaged, meat juices can be expelled from the meat and can detract from the appearance of the meat when viewed from the underside. Thus if transparent packaging is envisaged care will have to be exercised in the design of the packaging to minimise the visual effect of any such juices which may be expelled from the meat.

In overseas countries, it is common to package meat products and/or other food products into a tray which is made from a plastics material which comprises three layers of the plastics material. The tray is semi-rigid and is usually composed of layers of P.V.C. and POLYETHYLENE or alternatively P.V.C./P.V.D.C. and polyethylene. Meat is placed in the tray and then the tray is packaged with a flushing gas which preferably comprises 80% $O_2$ and 20% $CO_2$. The package has a clear lid which is a co-extruded film of NYLON and SURLYN (Trade Mark) or a laminated web of POLYESTER, P.V.D.C. and POLYETHYLENE. The lid material is sealed to the top edges of the tray and inhibits the escape of the gas from the package.

In the prior art packaging of fresh meat which is described above there are particular problems in adapting it to Australia. Two of the problems are that:

(a) The tray is not always transparent and therefore the contents are not always viewable.

(b) The materials from which the tray is made are very expensive.

In particular the tray of the prior art packaging is not substantially rigid but only semi-rigid and in order to prevent accidental damage such as by kinking of the tray which can then cause rupturing of the tray a more rigid container is required. If the tray or lid is ruptured the inert flushing gas can escape and then the contents can be contaminated by the outside atmosphere. The shelf life of the packaged products is then substantially reduced. Because the tray must be made thicker the cost then becomes prohibitive and further, as the cost of fresh meat in Australia is relatively inexpensive compared to that in other countries, the cost of such a tray represents a significant part of the overall cost of the package and this is commercially undesirable.

STATEMENTS OF THE INVENTION

Accordingly it is an object of the present invention to provide improved packaging. Certain embodiments overcome all the aforementioned problems.

Accordingly one form of the present invention may provide an improved packaging, particularly but not exclusively, for fresh meat, comprising a substantially rigid tray of plastics material such as polypropylene, said tray having strengthening formations therein, some of the formations being on the base of the tray and being such as to support and space any products therein above the lowermost portion of said strengthening formations, products in said tray, said tray being enclosed in a plastics material hermatically sealed closed transparent outer covering, said covering being such as to substantially exclude atmosphere from contacting the products.

Most preferably the products which are packaged are fresh meat products and the gas is a gas which maintains the freshness and also the colour of the meat within the packaging whilst restricting the prolific growth of bacteria.

The strengthening formations are preferably corrugations in the tray, which apart from providing strength to the tray also support the products above the lowermost portions of the strengthening formations. Thus, the troughs of the corrugations provide channels to assist the draining of any juices from the undersurfaces of the products. Thus, if the tray is transparent, the products when viewed from underneath will not be resting across the face of a planar bottom of a tray but on the crests thereof and thus the juices will not appear to be clinging to the undersurface of the products and hence will provide a more attractive appearance to a purchaser.

Preferably the tray is transparent and the bottom of the tray has a gable like contour. This is provided to cause any juices which may escape from products packaged therein, such as fresh meat, to drain to the lowermost portions of said gable like contour so as to thereby not greatly inhibit the viewing of the contents from the underneath of said tray.

It is also preferred that the plastics material ccvering is formed in two parts where one of the parts is a cup-shaped preform base in which the tray is seated and the other part is a lid part which is hermatically sealed to the uppermost surfaces of the cup-shaped preform part. It is also particularly preferred that the tray have gas passageway means therethrough near the uppermost surfaces of the side walls thereof so that any gas which is retained within the packaging volume as defined by the outer covering can pass from the underneath of the gable like contour of the bottom of the tray to the top of the tray.

Another form of the invention may provide an improved packaging method for producing air evacuated and desired gas filled packages, said method comprising:

(a) providing a tray for products to be packaged.

(b) inserting a product into the tray.

(c) placing the tray and package into a sealing station where the tray and package are fitted in a depression in a web of outer packaging material.

(d) introducing a web of further outer packaging material over the depression to provide a lid for said depression.

(e) closing an air evacuation chamber over the packaging component in the sealing station.

(f) evacuating air therefrom and allowing air to evacuate from the tray and the depression.

(g) allowing a desired gas to pass between the web and the depression.

(h) sealing the lid to the edge surfaces of the depression whereby to provide a sealed package containing a product and the desired gas, without substantially any air therein.

BRIEF DESCRIPTION OF DRAWINGS

FIG. 2 is a close-up plan view of the tray of FIG. 1;

FIG. 3 is a side sectional view of the tray shown in FIG. 1 taken along line 3-3 of FIG. 1 but showing the tray enclosed within a plastics material outer covering;

DESCRIPTION OF PREFERRED EMBODIMENTS

Figure 1:
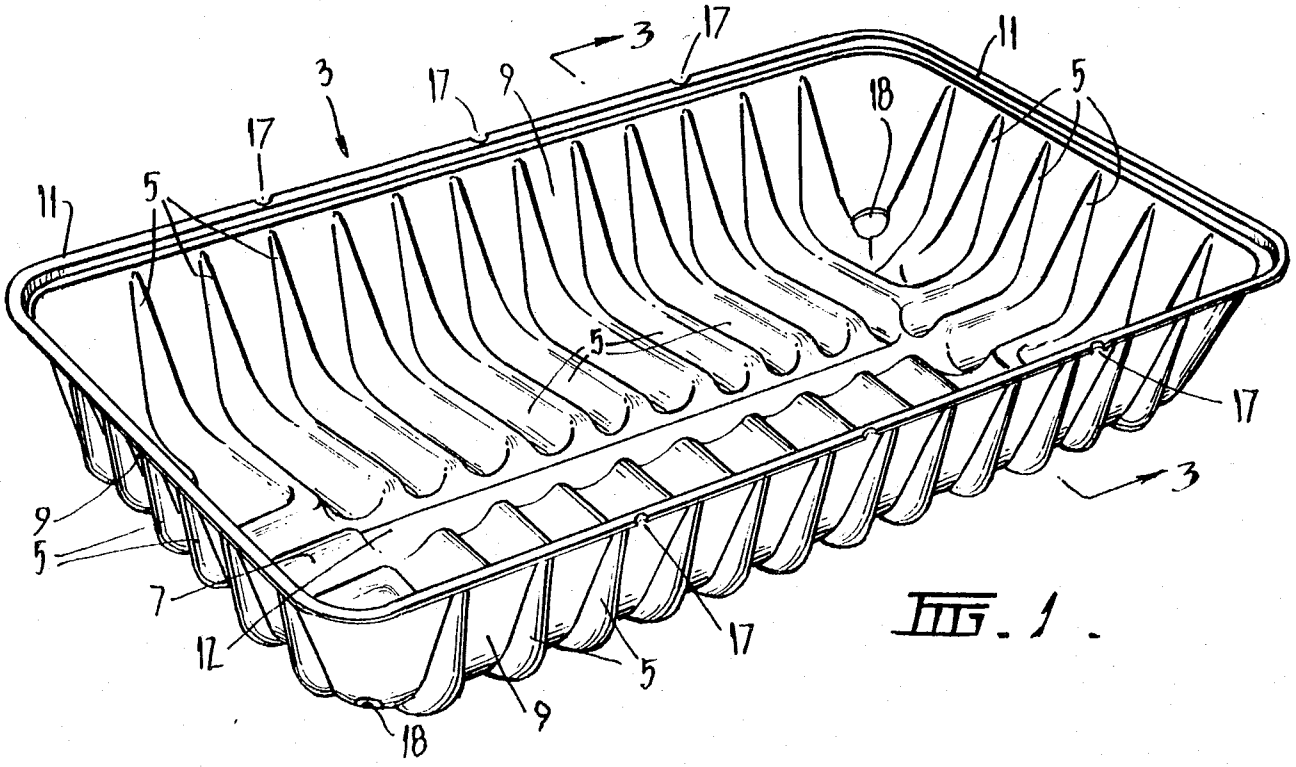
FIG. 1 is a top perspective view of a tray of the packaging without showing meat therein.

The packaging (see FIG. 3) comprises a two part outer covering 1, i.e. a lid 2 and a preform base 4. The outer covering 1 is of a transparent plastics material which will inhibit the escape of desired gas such as a product preserving and/or colour maintaining gas from the packaging. Suitable gases will be described more fully later. The covering 1 is preferably clear. The covering 1 is typically of a thickness of 75 microns and is very flexible. Typical materials from which the covering 1 can be made are co-extruded films of NYLON and POLYETHYLENE or polyester, P.V.D.C. and polyethylene.

A very rigid tray 3 is provided to support the meat. The tray 3 is thermo-formed from a preferably transparent and preferably clear plastics material such as POLYPROPYLENE. Because POLYPROPYLENE is relatively inexpensive particularly in Australia, it can be made relatively thick as in the order of 0.5 mm thickness. The cost of the materials for the tray 3 are therefore insignificant. The tray 3 is made substantially rigid by having a plurality of strengthening formations in the form of corrugations 5 therein. The corrugations 5 are in the bottom of the tray as well as in the side walls of the tray and therefore the tray 3 is extremely rigid and not likely to be dented and/or creased by dropping the package which could then cause rupturing of the covering 1 and the contamination of the meat by air which will then be admitted.

By inspecting FIG. 2 it can be seen that the tray 3 has a bottom 7 and side walls 9. The upper portions of the side walls 9 in turn, connect with a peripheral lip 11. The side walls 9 are slightly outwardly inclined whereby to assist nested stacking of blanks of the trays 3 prior to them being used to form packages. The bottom 7 of the tray 3 has a somewhat gable like contour. By inspecting FIG. 1 it can be seen that the gable contour extends across the package from the left hand side to the right hand side whilst when viewing across the tray 3 in a mutually perpendicular direction, the tray has a central region 12. Accordingly it can be seen that the contour of the bottom 7 of the tray 3 is such that the central region 12 is substantially higher than that of the side edges of the bottom of the tray 3 where the bottom 7 terminates with the side walls 9. It can also be observed that the corrugations 5 on the bottom 7 will act to support meat generally above the lowermost portion of the corrugations 5 therein (i.e. the troughs of the corrugations). This will support and space meat directly above the bottom 7 and the meat will only contact the actual bottom 7 along the tops of the corrugations 5 (i.e. the crests). Accordingly liquids which escape from the meat drain down the inclined surfaces of the contour of the gable shaped bottom 7 in the troughs of the corrugations to the bottom side edges of the tray 3. Accordingly, a viewer of the meat will able to inspect the meat from underneath the tray through the tray 3 and such viewing will not be greatly impaired by any liquids as the liquids will then generally be around the periphery of the bottom of the tray 3.

By inspecting FIG. 1 it can be seen that there are cut-outs 17 in the lip 11 of the tray 3. Apertures 18 are provided in each bottom corner of the tray 3. The purpose of the cut-outs 17 and apertures 18 will be explained later in relation to the gas which is retained within the packaging.

In the particular embodiment herein the base 4 of the covering 1 is formed as a generally cup-shaped preformed depression in a web of covering 1. The cup-shaped depression has substantially the same dimensions as that of the tray 3. Accordingly, it can be seen that the tray 3 can be seated by nesting within the base 4. The base 4 has outwardly inclined side walls 21 which terminate with an upper horizontally extending lip 23. The lip 23 extends outwardly away from the lip 11 of the tray 3 but it is situated close to the outermost portion of the lip 11. The bottom 25 of the base 4 extends generally horizontally and is planar as distinct from having a gable like contour.

In order to provide a package, fresh meat is placed in the tray 3, the tray 3 and the meat are then placed within the base 4 and the base 4 together with the tray 3 and the meat therein are advanced to an assembly station where the lid 2 comprising a film of covering material 1 is placed over the top of the base 4. The peripheral edges of the base 4 are then hermatically sealed as diagrammatically shown by numeral 31. The hermatic sealing is a continuous seal around the lip 23. This sealing can be performed by way of an impulse sealing technique or by other sealing techniques as will be explained later. Prior to completely sealing the lid 2 of the covering 1 to the base 4, the air within the tray 3 and the base 4 is flushed by a suitable gas which will assist in the preserving and colour keeping of the meat. The flushing process involves evacuaticn of the air and its replacement with the desired gas. A typical gas comprises 80% $O_2$ and 20% $CO_2$. For fresh vegetables it may comprise 5% $O_2$, 3% $CO_2$ and 92% $N_2$. By observing FIG. 3 it can be seen that there are spaces 33 between the side walls of the base 4 and the side walls 9 of the tray 3. Similar spaces are provided at the ends of the tray 3. They have not been shown in the drawings. A further space 35 is provided underneath the gable like bottom 7. It can be seen that the space 35 underneath the tray 3 and the spaces 33 at the side walls of the tray 3 and the further spaces at the ends of the tray 3 may be used to contain some of the volume of the gas which is required to assist in the keeping of the meat. In this connection it is known that there needs to be approximately an equal volume of gas to the volume of the meat. Accordingly with this embodiment, the apertures 17 and 18 in the tray 3 allow the gas from the spaces 33 and 35 to circulate and add with the gas within the tray 3 and therefore represent a total volume of gas larger than that in the tray 3 alone, which assists in the keeping of the meat.

With the construction proposed herein the covering material is still a relatively expensive material but because this is of a very thin nature its cost is minimized. On the other hand the cost of the tray 3 is substantially negligible owing to the relatively inexpensive cost of the POLYPROPYLENE material. Because the tray 3 is substantially rigid it inhibits rupturing of the covering 1 and therefore a very desirable packaging for meat is provided. Further, the gas within the package is under a slight pressure relative to atmosphere and hence the covering 1 is bowed outwardly in a balloon fashion, thereby assisting in maintaining the covering 1 in substantially non rupturable condition.

Figure 4:
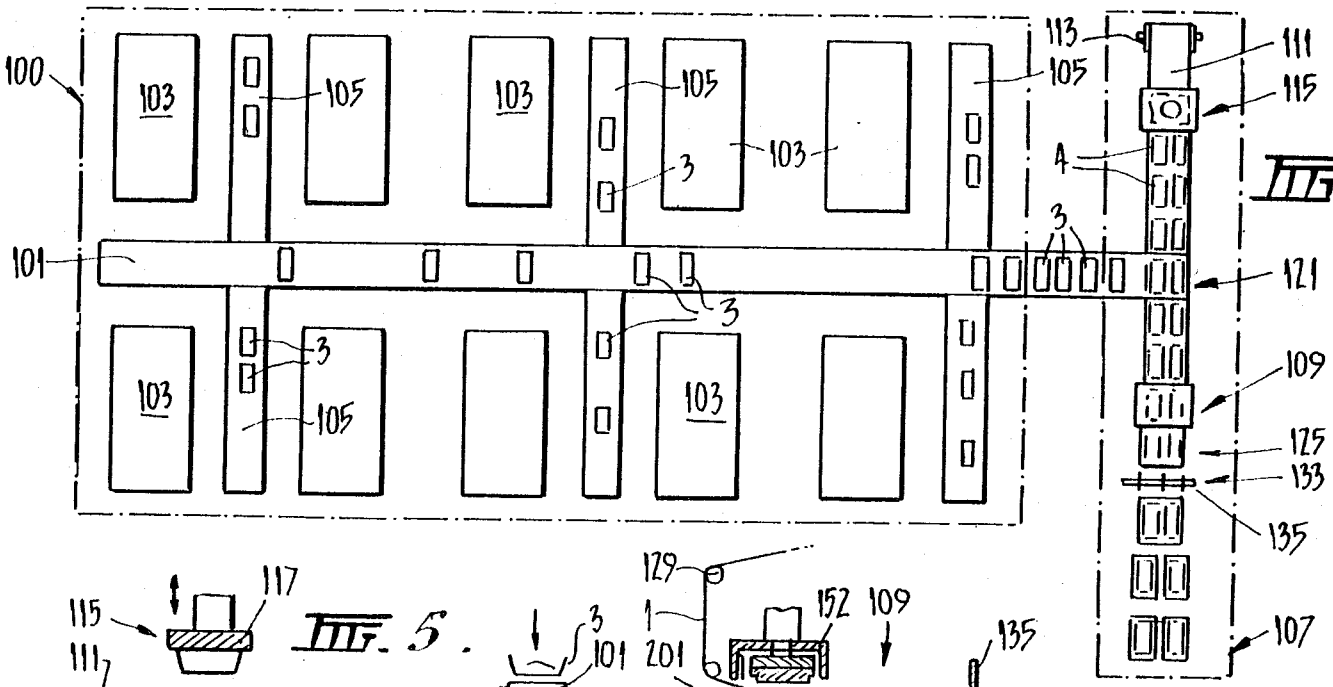
FIG. 4 is a schematic block diagram of a typical packaging installation at a meat processing plant.

Referring now to FIG. 4 there is shown a block schematic diagram of a typical packaging installation at a meat processing plant. In the installation there is provided a boning room 100 and in that boning room there is a main conveyor 101. The main conveyor 101 extends from a plurality of boning stations 103. Each of the boning stations 103 has secondary conveyors 105 thereat. In use, boners dissect meat at the boning stations 103 and place meat into the trays 3 which may be provided in suitable nested stacks at the boning stations 103. The meat packaged in the trays 3 is then placed onto the secondary conveyors 105 where the packages are transferred onto the main conveyor 101 and subsequently discharged from the boning room 100 into a packaging room 107. In the packaging room 107 there is provided a packaging machine 109.

Figure 5:
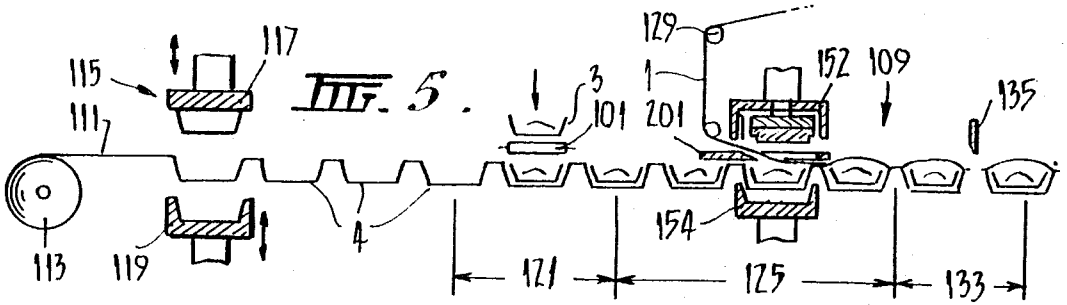
FIG. 5 is a schematic side view of a typical packaging machine installation.

Referring now to FIG. 5 there is shown a schematic side view of a typical packaging machine 109 as shown in FIG. 4. The packaging machine 109 packs two trays 3 of meat simultaneously i.e. in side by side relation to each other.

In the packaging machine installation shown in FIG. 4, preformed pairs of bases 4 are produced side by side in a continuous web of material 111 which is wound on a roll 113. The preform bases 4 are produced at a preform forming station 115. Here, there are dies 117 and 119 which are advanced towards the web 111 to thermo-form the shape of the preform bases 4 therein. The dies 117 or 119 may be heated or alternatively the web 111 may be heated just prior to entering the dies 117 and 119. The preform bases 4 are then advanced to a tray loading station 121 where trays 3 with meat therein are delivered from the conveyor 101 to the packaging machine 109.

The preform bases 4, the trays 3 and the meat therein are then advanced to a gas flushing and sealing station 125. At the gas flushing and sealing station 125, covering material 1 in web form is unwound from a pair of side by side rolls (not shown) of covering material 1 and passed over rollers 129 so that the webs of covering material 1 lie over the tops of respective ones of a pair of aligned side by side, open preform bases 4 with the trays 3 and meat therein.

Gas flushing and sealing then occurs.

The packages are then advanced to a guillotine station 133 where the packages are removed from the web 111 and discharged into a storage area. A guillotine 135 is used to sever the packages across the web 111. A slitting knife, not shown, is used to slit the two side by side packages from the web 111.

Figure 6:
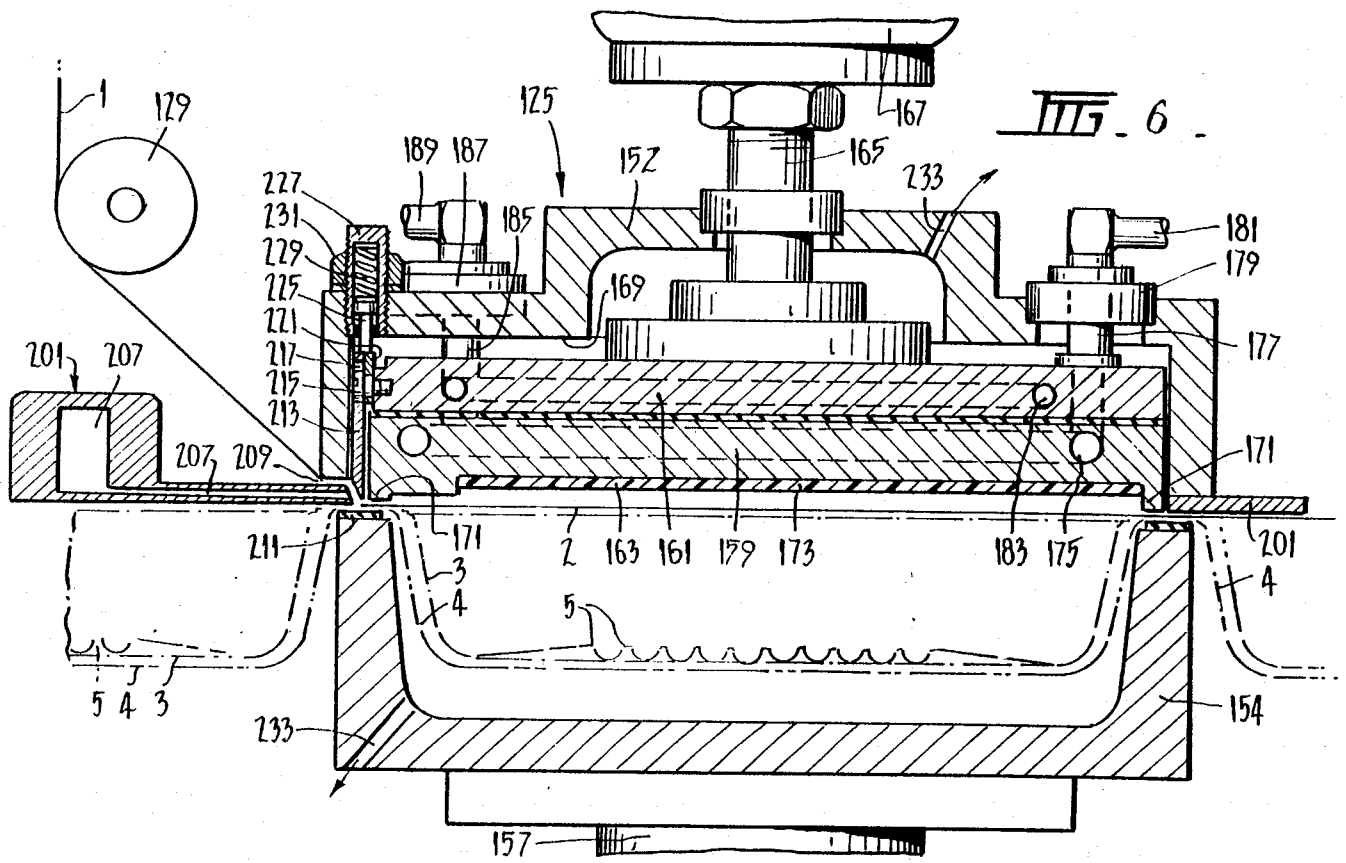
FIG. 6 is a close-up side cross-sectional view of a gas flushing and sealing station in the installation of FIG. 5.
Figure 8:
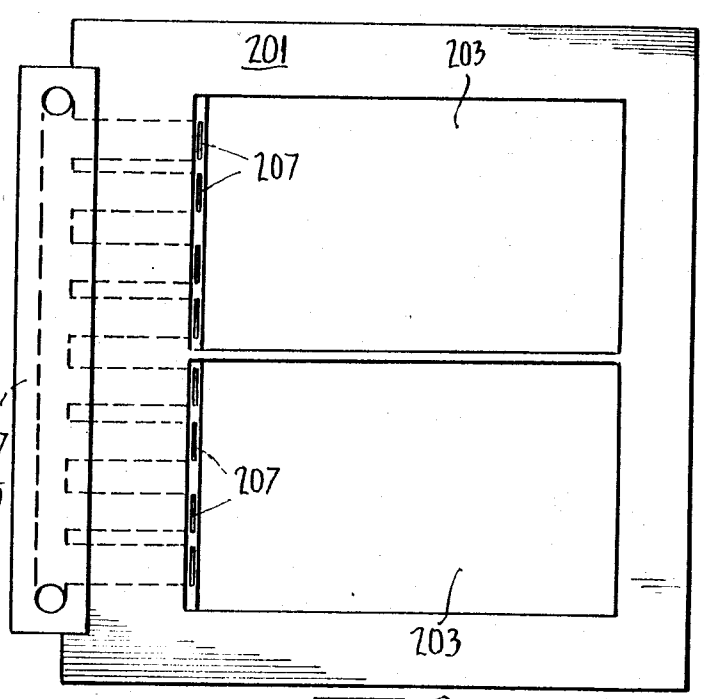
FIG. 8 is a plan view of a desired gas introducing means.
Figure 7:
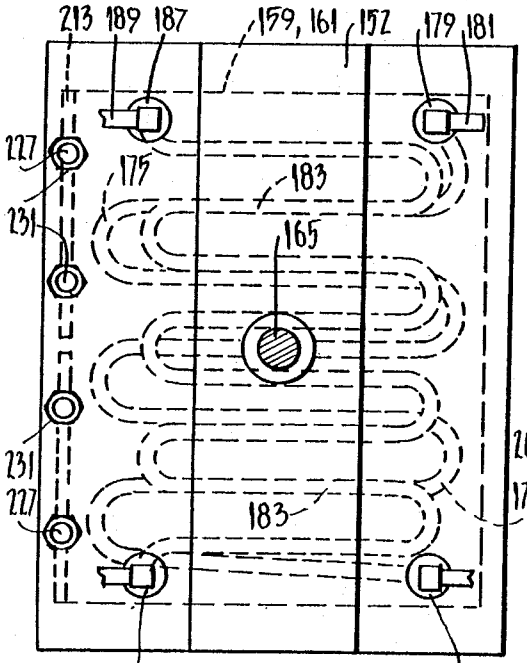
FIG. 7 is a plan view of the sealing station shown in FIG. 6.

Referring now to FIGS. 6 and 7 there is shown a detailed side cross-sectional view of the gas flushing and hermatic sealing station 125. The gas flushing and hermatic sealing station 125 includes an upper chamber 152 which is in use held stationary and a lower chamber 154. The lower section 154 is arranged for reciprocating movement on a ram 157. Thus, in use, the lower chamber 154 can be brought upwardly to mate on the undersurfaces of the upper chamber 152 thereby providing a substantially closed chamber at the gas flushing and hermatic sealing station 125. The upper chamber 152 has a platen 159 therein. The platen 159 is fastened to a further platen 161 with a web of thermally insulating material 163 sandwiched therebetween. The upper platen 161 is fastened to a ram 165 which, in turn, is connected with an air bag 167 which can cause the platens 161 and 159 to move upwardly and downwardly within the upper chamber 152.

In FIG. 6 the platens 161 and 159 are shown in the downwardly extended position. When they are in the upwardly retracted position, they assume a position near the upper inside surface 169 of the upper chamber 152. The platens 161 and 159 extend across the width of two packages in the packaging machine. By inspecting FIG. 6 it can be observed that the platen 159 has peripheral downwardly protruding sealing edges 171. These downwardly protruding sealing edges 171 extend around the perimeter of each of the bases 4 of the outer coverings 1. The lower chambers 154 are divided into two parts such that the bases 4 and trays 3 which are nested in the bases 4 can locate in a respective one of the two parts of the lower chamber 154. This is clearly shown in FIG. 7.

The undersurface of the platen 159 is relieved in the central area thereof and contains an insulation material 173. The insulation material 173 may be of asbestos or of other known thermally insulating material. The purpose of the insulating material 173 is to extend over a major part of the lower surface of the platen 159 so that the lid 2 will not touch the undersurface of the platen 159 except around the peripheral edges 171. It will be appreciated that the platen 159 is heated in order to effect hermatic sealing of the lid 2 to the base 4. The heating may be by an impulse heating means or as shown in the embodiment it may be by passing heated liquid through passageways 175 therein. Typically the passageways 175 form a tortuous pass across the platen 159 so that it is heated generally uniformly. The heated liquid is passed to and from the passageways 175 through vertically rising steel pipes 177 which rise through the upper platen 161 and through the upper surface of the upper chamber 152. A gland means 179 is provided on the pipes 177 and on the upper chamber 152 and allows for reciprocated sliding movement of the pipe 177 as the platens 159 and 161 are raised and lowered by the ram 165 and also permits an airtight seal with the chamber 152. Flexible pipes such as hoses 181 can be attached to the tops of the pipes 177 to enable the heated liquids to pass through the passageways 175.

The upper platen 161 is cooled rather than heated. The purpose of this will be explained in due course. Here cooling fluids are passed through passageways 183 which also form a tortuous path across the upper platen 161. Steel pipes 185 connect with the passageway means 183 and pass through glands 187 fastened to the upper chamber 152 and allow for sliding movement of the pipes 185 therethrough as the platens 161 and 159 are raised and lowered. Hoses 189 can be connected to the tops of the pipes 185 to allow the cooling fluids to pass through the pipes 185 and into the passageways 183.

The thermally insulating material 163 is placed between the platens 159 and 161 to thermally isolate each platen from the other.

A gas flushing member 201 is provided between the upper and lower chambers 152 and 154. The gas flushing member 201 is attached to the upper chamber 152. The gas flushing member 201 has two rectangular shaped openings 203 therein which respectively align with the two parts of the lower chamber 154 in which the bases 4, and preforms 3 are located. The gas flushing member 201 is typically of metal such as brass.

It can be seen that the covering material 1 which is used to provide the lids 2 of the packages passes through the respective openings 203. Accordingly the webs 1 pass around the roller 129 across the top of the gas flushing member 201 and through the openings 203 and then across the undersurface of the gas flushing member 201 at the other side of the gas flushing member 201 to which the roller 129 is positioned.

The gas flushing member 201 has central passageway means 207 therein which communicate with each of the openings 203. It can be seen that the passageways 207 terminate with the openings 203 midway between the thickness of the gas flushing member 201 where it passes underneath the upper chamber 152. A small space 209 is provided between the gas flushing member 201 and the lower edge surface of the upper chamber 152 where the covering material 1 passes from the top of the gas flushing member 201 through the openings 203. This is clearly shown in FIG. 6.

The upper surface of the lower chamber 154 is provided with a neoprene sheet 211 which surrounds the two parts in the lower chamber 154 in which the bases 4 and the trays 3 are received. The neoprene sheet 211 is provided to effect substantial atmosphere sealing of the chambers 152 and 154 when those chambers are brought together to define a closed gas flushing and hermatic sealing station 125. It is noted, however, that there is not complete sealing because there is a small space provided by the opening 209 where the covering material 1 passes into the gas flushing and hermatic sealing station 125.

The platen 161 carries two spring loaded pushing knife like members 213. The knives 213 extend across the width of a respective one of the two parts of the lower chamber 154 in which the bases 4 and trays 3 are received. The knives 213 each comprise a bar like metal member which is attached to the upper platen 161. The attachment is by way of four screws 215 which pass into the side of the upper platen 161 which is adjacent the outlet of the passages 207 in the gas flushing member 201. The screws 215 each have their heads located in respective elongate slots 217, such that the knives 213 can move upwardly and downwardly at the side edge of the platens 161 and 159. A planar bearing material 221 is provided between the knives 213 and the side edge of the upper platen 161. The bearing material 221 allows for relatively easy sliding movement of the knives 213 in the up and down direction.

The knives 213 are connected at their upper edge surfaces with four push rods 225 which, in turn, are slidably received within respective tubular members 227. Each tubular member 227 is threaded on its external surfaces and is screw threaded in a suitable aperture in the upper surface of the upper chamber 152. Thus, the tubular member 227 can be extended or retracted into the aperture. A compression spring 229 is fitted within the tubular member 227 and by appropriate screw adjustment of the screw member 227 desired pressure can be applied from the spring 229 to the top of the push rods 225 to, in-turn, bias the knives 213 to the downwardly extended position. A suitable respective lock nut 231 holds the tubular threaded member in the desired adjusted position. The push rods 225 and tubular members 227 are positioned uniformly spaced apart along the length of the knives 213 so that the knives 213 are urged downwardly substantially uniformly along their length.

When the platens 161 and 159 are raised the push rods 225 compress the springs 229. When the platens 161 and 159 are extended downwardly to the position shown in FIG. 6, the springs 229 maintain the knives 213 extended downwardly below the lower surface of the downwardly extending sealing edges 171 of the platen 159 so that the lowermost edge of the knives 213 contacts the web 1 and pushes the web 1 downwardly onto the upper surface of the neoprene sheet 211. This is provided to inhibit the web of material 1 from contacting the heated lower platen 159 until the web 1 is brought down to engage the peripheral lip of the base 4.

Because the upper platen 161 is cooled, knives 213 are cooled - i.e. they are at a lower temperature than that of the heated platen 159. Thus, the lowermost edge of the knives 213 do not effect any heat sealing of the upper web 1 to the peripheral lip of the base 4.

Air evacuation openings 233 are provided in the upper and lower chambers 152 and 154. In use air is evacuated from these openings when the upper and lower chambers 152 and 154 are closed and prior to insertion of gas through the gas flushing member 201.

The sequence of operation of the gas flushing and sealing station 125 is as follows. When the bases 4, complete with trays 3 and with meat therein are indexed into the gas flushing and sealing station 125 they locate directly above the two parts in the lower chamber 154. In this position the lower chamber 154 is retracted to allow the bases 4 and trays 3 and meat to index into this position. The lower chamber 154 is then closed by extending ram 157. The platens 161 and 159 are retracted at this stage. Air is evacuated through the air evacuation openings 233 in both the upper and lower chambers 152 and 154. After the air is being evacuated, gas is introduced via the gas flushing member 201 so that it leaves the passageway means 207 and passes into the bases 4 and trays 3 between the upper lip of the bases 4 and the webs of material 1. Thus, air which is exhausted through the air evacuation openings 233 is replaced by a gas such as 80% $O_2$ and 20% $CO_2$. After a sufficient time to allow for the base 4 and tray 3 to be filled with this gas, the platens 161 and 159 are lowered. The lowermost surface of the blade 213 then contacts the upper surface of the material 1 of the lid 2 and causes it to engage with the upper surface of the lip of the base 4 on the neoprene sheet 211. The gas supply to the gas passages 207 is then stopped. Continued downward movement of the platens 161 and 159 causes the lower platen 159 to engage with the upper surface of the material 1 of the lid 2 and to effect hermatic heat sealing of the lid 2 to the base 4. Thus the gas is hermatically sealed within the package. The platens 161 and 159 are then retracted and the lower chamber 154 is also retracted. The package is then indexed out of the gas flushing and sealing station 125. In this condition, the package is integrally connected with the web of material 111 from which the bases 4 are made.

After the packages are indexed out of the gas flushing and sealing station 125, they pass into the separating station 133 where the packages are separated from the web of material from which the bases 4 are made by the knife 135 and by a slitting knife (not shown).

Appropriate hydraulic and/or pneumatic circuitry and appropriate electronic circuitry is provided to effect the necessary indexing and operation of various rams and knifes and operation of air evacuation and gas flushing. The design of these items is considered within the skill of any addressee familiar with the art of packaging machines generally. Accordingly it has not been disclosed herein as it does not form any part of the inventive concepts.

The packages so produced will provide for a generally long shelf life of the packaged meat.

It should also be appreciated that because the gas which is trapped within the base 4 and the lid 2 is totally available for circulating within the package by reason of the openings 17 in the peripheral lip of the tray 3 and by reason of the openings 18 in the bottom corners of the tray 3, that a relatively smaller pack can be provided than with other types of packages where for example there is no circulation of gas which may be trapped in the spaces 33 and 35 between the tray 3 and the base 4. Thus, substantially more product can be packed in any given space. Desirably the packs are made sufficiently large as to accommodate desired weights of meat.

It should be appreciated that because the gas which is introduced into the package 1 is under a slight pressure relative to atmosphere, that the package 1 is initially inflated somewhat and bows slightly outwardly. This enables the package to have a substantially outwardly directed force supplied to the packaging materials of the lid 1 and the base 4 and this generally inhibits easy rupturing of the lid 2 or the base 4 material. It should also be appreciated that the tray 3 is not attached in any way to the lid 2 or the base 4. It merely rests between the lid 2 and the base 4.

The openings 18 in the bottom corners of the trays 3 also allow the trays 3 to easily drop into the bases 4, as such openings allow air under the trays 3 to readily escape during the insertion process. It has been found that if the openings are not present then the air trapped between the trays 3 and the bases 4 can cause upwardly directed forces to be applied to the trays 3 during the insertion process and such forces can cause the trays 3 to skew slightly within the bases and completely upset the operation of the packaging machine.

If the packaging is to contain fresh vegetables it is desirable that the outer covering, i.e. the lid 2 and the preform base 4, be of a material that will allow any $CO_2$ which may generate within the package to escape and allow $O_2$ to permeate into the package to replace the $CO_2$ which escapes. Accordingly, it is desirable for the outer covering material to be made of polyethylene or like plastics material which will permit this to occur.

It should also be appreciated, that some products to be packaged, such as fish or poultry, will absorb $CO_2$ from the gas after packaging. With the present apparatus and packaging, it is possible to over inflate the package to a desired amount initially, so that when the $CO_2$ is absorbed, the final volume of the package will be the required volume. If the outer packaging material has NYLON as one of the web materials, then NYLON has a memory, and thus the natural shrinkage which occurs because of this memory when the outer packaging material reduces in volume because of the absorbtion of some of the gas into the product, can be equated to this memory shrinkage so that the outer packaging material will not be slack or even worse, shrunk to a degree that collapses and ruptures the package. This permits the outer packaging to be in a condition which inhibits total collapse or rupturing which may otherwise occur if it were not compensated for. Thus, with the present packaging it can contain 100% $CO_2$ if desired without any real packaging problems occuring.

I claim:

1. An improved packaging method for producing an air evacuated and desired gas filled package, said method comprising:

(a) providing a cup shaped depression in a web of package material to provide a packaging base, (b) providing a product in said depression, (c) providing a cover for said base, (d) providing a gas flushing member between the cover and the base, said gas flushing member being plate like and having an opening therethrough, (e) passing said cover through said opening so that it extends from one face of the gas flushing member, through said opening, to the opposite face of the gas flushing member and over said depression, said gas flushing member having gas passageway means therein which terminates with said opening in the region where said cover passes through said opening from said one face, (f) closing an air evacuation chamber over the components and the gas flushing member so that it makes a substantially air tight seal with said one face and said opposite face, (g) evacuating air from said air evacuation chamber so that air within said depression will be evacuated, (h) expelling desired gas from said gas passageway means so that it discharges between said cover and said base and can enter said depression, (i) sealing the cover to said base around the edge surfaces of said depression, whereby to provide said air evacuated and desired gas filled package.

2. The method of claim 1, wherein said web in which said depression is formed is elongate and there is the step of forming a plurality of depressions along the length thereof.

3. The method of claim 2 wherein the gas passageway means terminate at a side of said opening which is between adjacent depressions and closest to the next depression to be sealed in said web.

4. The method of claim 2 including the step of separating said air evacuated and desired gas filled package from said web after sealing of said cover thereto.

5. The method of claim 1 including providing a platen within said air evacuation chamber and including the step of relatively moving said platen towards said cover after the desired gas has been expelled whereby to close said cover over said depression to effect sealing of said cover to said base.

6. The method of claim 1 including heating said platen and therby effecting heat sealing of said lid to said base.

7. The method of claim 6 including pushing the portion of said cover which is adjacent said one surface of said gas flushing member against said edge surface of said depression with a member which is cooler than said platen prior to causing said platen to touch said cover and then effecting said heat sealing of said cover to said base.

8. The method as claimed in claim 1 including the further step of providing a tray in said depression and providing said product in said tray.

9. The method as claimed in claim 8 including placing said product in said tray at a tray loading station and then placing the loaded tray in said depression.

10. Apparatus for producing packaging comprising: a gas flushing and sealing station, means for receiving a base with a product therein, a cover therefor, said gas flushing and sealing station means including a first chamber part and a second chamber part which together define an air evacuation chamber, said second chamber part being for receiving said bases with said product therein, said first chamber part and said second chamber part being, in use, closeable onto a gas flushing member, said gas flushing member being plate like and having one face and an opposite face with an opening therethrough, through which said cover can pass to extend over said base, said gas flushing member having gas passageway means therein which teminate with said opening in the region where, in use, said cover passes through said opening from said one face, said first chamber part having sealing means therein for effecting sealing of said cover to said base.

11. Apparatus as claimed in claim 10 wherein said sealing means is a platen which is, in use, connectable with heating means whereby said platen can be heated to effect heat sealing of said cover to said base.

12. Apparatus as claimed in claim 11 wherein said platen carries a member which extends forwardly of the pressing surface of said platen, said member being mounted to push the portion of said cover which extends from said one face through said opening, against said edge surface of the depression, prior to said platen pressing cover against said base.

13. Apparatus as claimed in claim 12 wherein said member is not directly heated by said heating means and is therefore cooler than the pressing surface of said platen.

14. Apparatus as claimed in claim 13 wherein said platen is in two parts, one part including the pressing face and wherein said one part is heated, said member being mounted to the other part.

15. Apparatus as claimed in claim 14 wherein said other part is cooled by cooling means.

16. Apparatus as claimed in claim 12 wherein said member is mounted to said platen.

17. Apparatus as claimed in claim 10 wherein said first chamber part and said second chamber part have air evacuation mcans connected therewith.

* * * * *